United States Patent [19]

Beust

[11] Patent Number: 5,048,668

[45] Date of Patent: Sep. 17, 1991

[54] MOUNTING AND DRIVING MECHANISM FOR A DRIVING GEAR

[75] Inventor: Wolfgang Beust, Dusseldorf, Fed. Rep. of Germany

[73] Assignee: Krupp Industrietechnik GmbH, Duisburg, Fed. Rep. of Germany

[21] Appl. No.: 610,448

[22] Filed: Nov. 8, 1990

Related U.S. Application Data

[63] Continuation of Ser. No. 851,308, Apr. 9, 1986, abandoned, which is a continuation of Ser. No. 639,601, Aug. 9, 1984, abandoned, which is a continuation of Ser. No. 396,792, Jul. 9, 1982, abandoned.

[30] Foreign Application Priority Data

Aug. 22, 1981 [DE] Fed. Rep. of Germany ..... 3133344

[51] Int. Cl.[5] ..... B65G 17/36

[52] U.S. Cl. ..... 198/509; 198/518; 37/190

[58] Field of Search ..... 198/509, 518; 414/133, 414/224; 37/189, 190

[56] References Cited

U.S. PATENT DOCUMENTS

| | | | |
|---|---|---|---|
| 1,884,646 | 10/1932 | Frappier et al. | 464/182 X |
| 2,788,200 | 4/1957 | Bassett | 198/518 X |
| 2,826,839 | 3/1958 | Kolbe | 37/190 |
| 2,889,123 | 6/1959 | Hayden | 242/68.3 |
| 2,903,200 | 9/1959 | McDougall et al. | 242/68.2 |
| 3,052,050 | 9/1962 | Wilms et al. | 198/509 X |
| 3,070,286 | 12/1962 | Weaving | 464/182 |
| 3,075,369 | 1/1963 | Swire | 464/182 |
| 3,083,927 | 4/1963 | Prosin | 242/68.3 |
| 3,214,107 | 10/1965 | Atkin | 242/68.3 X |
| 3,215,358 | 11/1965 | Way | 242/68.3 |
| 3,470,635 | 10/1969 | Langner et al. | 37/190 |
| 3,628,290 | 12/1971 | Wilson et al. | 464/147 |
| 4,037,713 | 7/1977 | Soliman et al. | 198/834 X |
| 4,187,698 | 2/1980 | Ohlson | 464/157 |
| 4,353,606 | 10/1982 | Bitsch et al. | 384/471 |

FOREIGN PATENT DOCUMENTS

| | | | |
|---|---|---|---|
| 952067 | 11/1956 | Fed. Rep. of Germany . | |
| 968959 | 4/1958 | Fed. Rep. of Germany | 37/190 |
| 1112463 | 8/1961 | Fed. Rep. of Germany | 37/189 |
| 2016324 | 11/1971 | Fed. Rep. of Germany | 37/189 |
| 2356890 | 5/1975 | Fed. Rep. of Germany | 37/189 |

*Primary Examiner*—Robert P. Olszewski
*Assistant Examiner*—James R. Bidwell
*Attorney, Agent, or Firm*—Schweitzer Cornman & Cross

[57] ABSTRACT

A paddle wheel, bulk-goods pick-up and moving device is disclosed, which picks up bulk goods from a storage container and deposits the same into the paddle wheel's interior. The device is provided with a motor-driven driving gear provided with a coaxially extending drive shaft immediately adjacent the driving gear. The shaft is provided with external serrations, and the interior central bore of the paddle wheel is provided with complementary internal serrations which matingly engage with the serrations of the drive shaft. The drive shaft, which causes the paddle wheel to rotate, is provided on the end opposite to the driving gear, with a connecting shaft portion which passes through the central bore of the paddle wheel. At the free end of the connecting shaft, a fastening mechanism is provided to secure the paddle wheel in close-coupled relation to the driving mechanism. A torque support connects the driving gear to the main structure.

2 Claims, 2 Drawing Sheets

MOUNTING AND DRIVING MECHANISM FOR A DRIVING GEAR

This application is a continuation of application Ser. No. 851,308, filed Apr. 9, 1986, now abandoned, which is a continuation of Ser. No. 639,601, filed Aug. 9, 1984, now abandoned, which is a continuation of Ser. No. 396,792, filed July 9, 1982, now abandoned.

BACKGROUND OF THE INVENTION AND DESCRIPTION OF THE PRIOR ART

The invention relates to a mounting mechanism for driving gears, particularly planetary-type gears having torque support. The present invention is particularly useful for mounting and rotatively driving paddle wheels or similar bulk goods moving devices.

As is known, paddle wheels are driven and rotated by the driven shafts of the paddle wheel. Motors with built-on planetary gears drive the centrally located shafts. In using paddle wheels which move the bulk goods so that they discharge the goods to their interior, it is not possible to have the planetary gears arranged in the interior of the paddle wheel. It is customary, therefore, to add the driving gear laterally, i.e., coaxially to the paddle wheel rotating axis. This lateral arrangement of the gear has, however, the disadvantage that the protruding driving gear negatively influences the so-called free-cutting angle of the paddle wheel so that the performance of the paddle wheel apparatus is negatively influenced by the necessity of the free-cutting angle.

The distance between the paddle wheel and the driving gear, and therefore the degree to which the driving gear protrudes beyond the paddle wheel, are enlarged by coupling elements which must be provided between the gear and paddle wheel in order to transmit the torque. It is conventional to provide flange couplings for connecting the driving gear and the paddle wheel, to use divided clamping rings, or to mount the paddle wheel with the aid of shrinking plates. All of these solutions, however, share the disadvantage that they consume considerable space, thereby further increasing the protrusion of the driving gear laterally from the paddle wheel and the free-cutting angle. Beyond that, the flange couplings and shinking plates have the disadvantage of large bending moments for the connecting structure and the clamping rings are hard to build-in because many fastening screws must be provided between the driving gear and the clamping ring. Furthermore, the screws are exposed to high stress by very small movement and motions between the driving gear and the paddle wheel and bearing and exhibit a tendency to break.

Starting from these problems and disadvantages, the object of the present invention is to provide a mounting mechanism of the initially described type such that the free-cutting angle between the driving gear and the paddle wheel is eliminated, i.e., the driving gear is directly connected to the paddle wheel and, yet, the paddle wheel discharges towards its interior.

SUMMARY OF THE INVENTION

In order to solve the problem of the prior art mechanism, the following characteristics, according to the present invention, are used:

(a) The secondary drive shaft of the driving gear is provided with an externally serrated circumference, for example, it has a multi-groove profile;

(b) The externally serrated circumference, just mentioned, acts as an internal toothed unit which is insertable into and matingly engages with the rotative central axis of the paddle wheel;

(c) A connecting shaft, coaxially passing through the paddle wheel, is fastened to the exposed frontal side of the secondary shaft of the driving gear; and (d) The exposed end of the connecting shaft is provided with a fastening mechanism which is supported against the front side of the paddle wheel, i.e., the side of the paddle wheel facing away from the driving gear.

The significant results obtained by the invention stems from the fact that the securing of the driving gear to the paddle wheel has been transferred to the side of the paddle wheel facing away from the driving gear due to the fixing of the secondary shaft of the driving gear to the connecting shaft. The external serrated circumference on the secondary shaft of the driving gear serves to transfer the torque to the paddle wheel. The external serrated circumference matingly engages with the internal serration of the paddle wheel. In this manner, no clearance is required between the paddle wheel and the driving gear because the driving gear, resting directly adjacent the paddle wheel, has its secondary shaft directly meshing with the paddle wheel.

Another characteristic of the present invention provides a resilient, intermediately located member, arranged between the fastening mechanism and the side of the paddle wheel directed away from the driving gear. The resilient member is located on the exposed end of the connecting shaft.

The resilient, gear fastening member, evidences the advantage that very small movement between the gear fastening mechanism and the bearing of the paddle wheel will not lead to a fatigue fracture of the fastening mechanism.

The fastening mechanism is, preferably, a screw or nut, and the resilient intermediately located member is designed as a cup-shaped spring.

In order to make sure that the fastening arrangement of the driving gear remains intact, during operation, it is proposed according to a further characteristic of the invention, to secure the screw or nut against inadvertent rotation. This may be achieved by conventional means, with the aid of screw locking devices or a keyed plate which is secured at the body of the paddle wheel.

Another advantageous feature of the present invention is that the connecting shaft is an element of the secondary drive shaft of the driving gear, meaning that the secondary drive shaft of the driving gear, designed of a corresponding length, passes through the center of the paddle wheel.

An exemplary embodiment is illustrated in the drawing and described below.

DETAILED DESCRIPTION OF THE INVENTION

Figure 1:
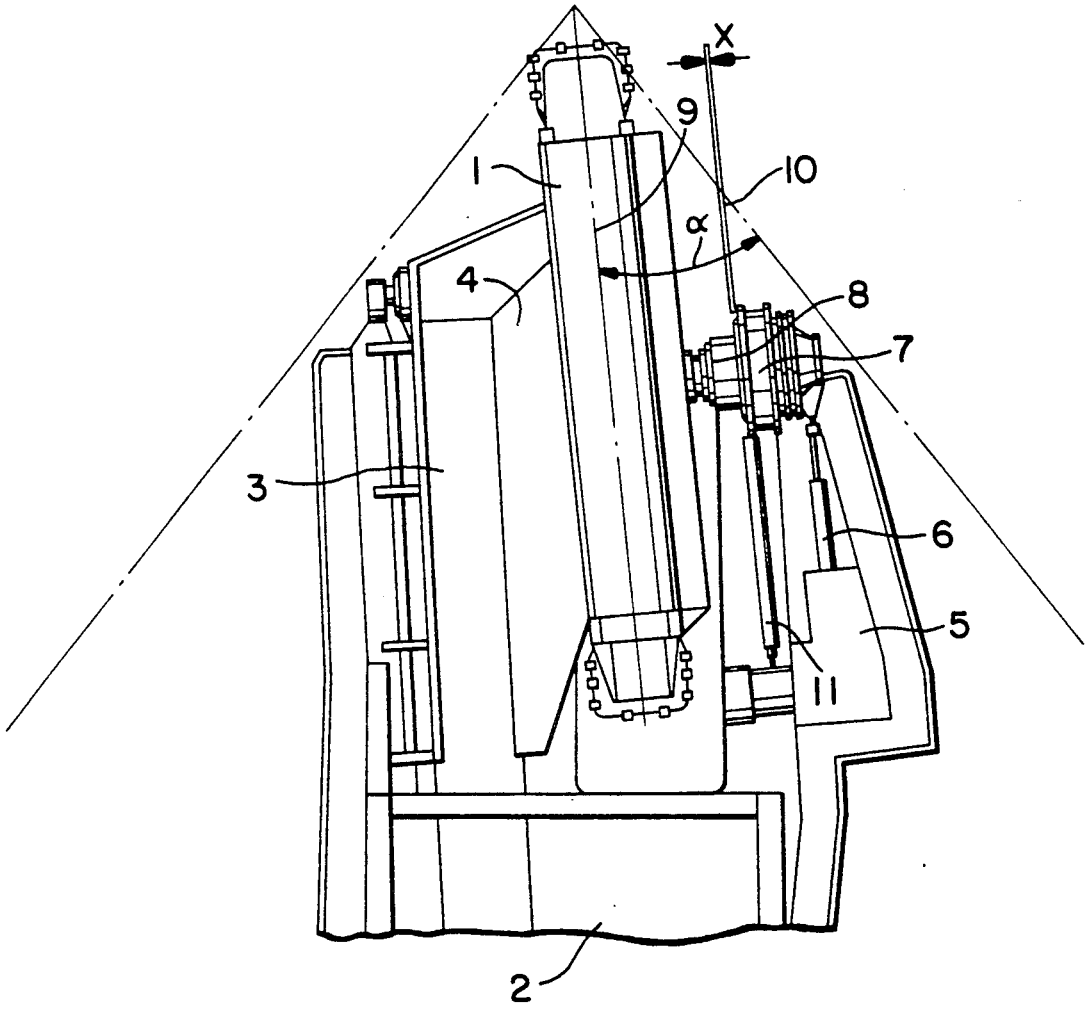
FIG. 1 is a schematic top plan view of a paddle wheel shank, paddle wheel and driving gear.

The paddle wheel 1, as seen in FIG. 1, is inclined by a predetermined angle in relation to a main support boom 2. A discharge chute 4 receives the bulk goods from the interior of the paddle wheel 1 and deposits them onto a conveyor belt 3. The paddle wheel is powered by a motor 5 (schematically illustrated) which initiates the wheel driving torque and transmits the power through the drive shaft 6 and to the driving gear 7. The gear 7 (see FIGS. 1 and 2) is connected to the paddle wheel 1, as indicated at 8. In addition, the gear 7 is supported (to prevent shifting) in relation to the shank 2, by the torque support 11.

The definition, for the purposes of the invention described herein, of the free-cutting angle $\alpha$ is indicated in FIG. 1. This free-cutting angle $\alpha$ is defined on one side by the center plane in which the paddle wheel rotates, indicated as 9 in FIG. 1, and the boundary line 10 basically or approximately defined by a line connecting the edge of the paddles and the driving mechanism for the paddle wheel. It can be seen from FIG. 1 that angle $\alpha$ basically or approximately corresponds to the theoretical area capable of being reached by the paddle wheel for picking up and conveying bulk goods, bearing in mind the physical constraints and limitations imposed by the location of the paddles and the bulky driving gear mechanism located on the side. It should be clearly seen that the angle $\alpha$ becomes smaller as the structural elements, such as gear 7, coupling 8, etc. (arranged at the paddle wheel) become closer arranged to the paddle wheel in the present invention, because of the elimination of all connecting couplings, the connecting dimension X between driving gear 7 and bearing 12*a* is zero. Therefore, an extremely small free-cutting angle $\alpha$ is provided, which serves to enhance considerably the performance of the apparatus.

Figure 2:
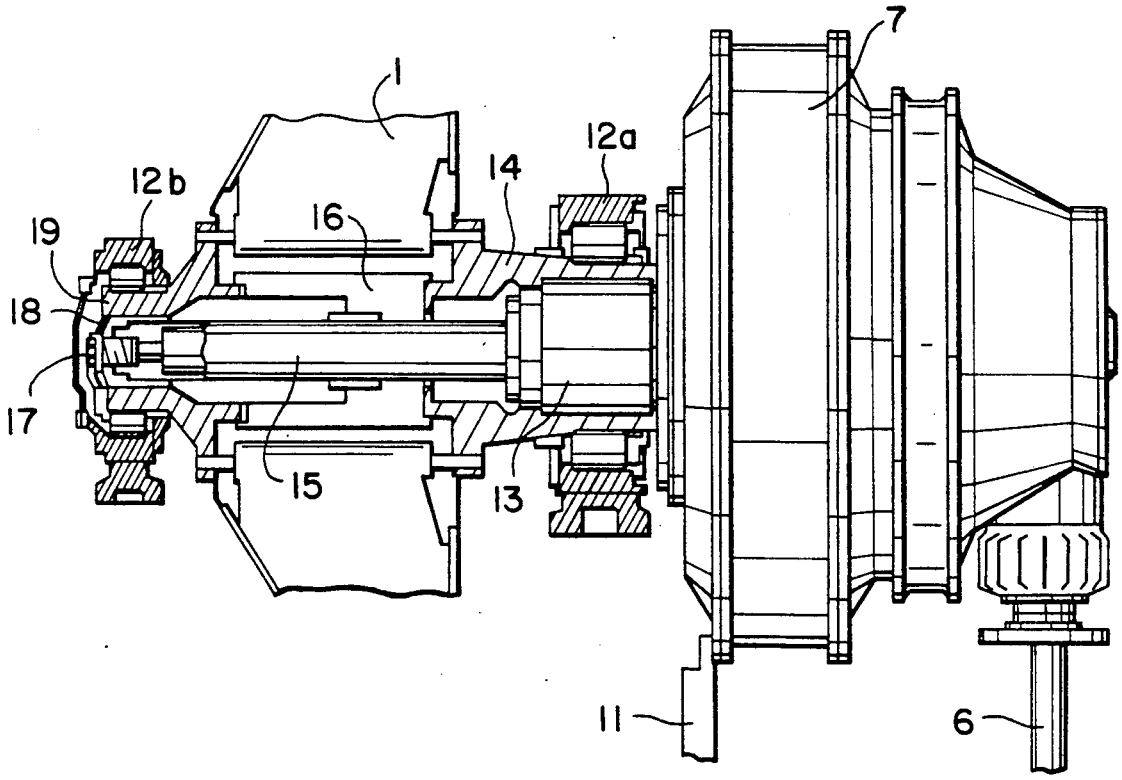
FIG. 2 is a schematic and cross sectional view of the mechanism for securing the driving gear to the paddle wheel.

The fastening mechanism, according to the invention, is shown in FIG. 2. Again, the central portion of the paddle wheel is indicated as 9. The gear 7 is, as previously described, connected to the motor by the drive shaft 6 (partially shown). The secondary (output) drive shaft 13 of the driving gear 7 is provided with a serrated outside profile which is inserted into a correspondingly designed serrated inside profile of a hub 14 forming part of the paddle wheel 1. As shown in FIG. 2, bearings 12*a*, 12*b* support the paddle wheel on opposite sides. In the illustrated example, the serrated or multiply grooved paddle wheel hub 14 extends inside the bearing 12*a* and is located proximal to the driving gear 7.

The connecting shaft 15 is screwed or otherwise fastened into the frontal side of the secondary drive shaft 13 of driving gear 7 and extends, coaxially to the rotating axis of the paddle wheel 1, through a bore 16 of the paddle wheel. A screw 17 is screwed into the exposed end of the connecting shaft 15. Screw 17 is abutted by a cup spring 18 and pressed against the paddle wheel at 19. The support surface of the cup spring 18 is, in the illustrated example, part of the bearing structure for the paddle wheel bearing 12*b*. The screw 17 and cup spring 18 hold the driving gear 7 in close-coupled relation to the paddle wheel 1, as shown in FIG. 2.

The driving gear 7 is rotatively fixed, by screw 17, passing into the connecting shaft 15. The cup spring 18 creates a resilient balance of very small forces and motions. The transfer of the drive moment occurs through the secondary drive shaft 13 which, as mentioned, is provided with the multi-groove or serrated profile of the driving gear 7.

It is advantageous to use a hydraulic construction for facilitating the mounting and removal of the apparatus from the center of the paddle wheel. Such a construction allows for the pulling of the connecting shaft 15 through the bore 16 of the paddle wheel. This makes it possible to reduce the time required for mounting the paddle wheel, thereby also yielding, besides the lesser construction width of the paddle wheel and gear, economical advantages.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. In an apparatus for moving bulk goods and of the type comprising (a) a main support boom, (b) a paddle wheel rotatably mounted on said support boom for moving the bulk goods and discharging them to its interior, (c) a discharge chute positioned to receive goods from the interior of the paddle wheel, (d) a conveyor positioned to receive goods from said discharge chute, (e) a drive motor mounted on said support boom, and (f) a drive gear mechanism interposed between said motor and said paddle wheel for effecting driven rotation of said paddle wheel, the improvement characterized by (g) said paddle wheel having a hub portion provided internally with a serrated internal profile, (h) said drive gear mechanism having an output shaft of serrated external profile removably received within said hub portion in driving relation therewith, (i) a connecting shaft portion joined to and extending from the end of said output shaft, (j) said connecting shaft portion extending coaxially through said paddle wheel and having a portion exposed on the side of said paddle wheel opposite to said drive gear, (k) fastening means engaged with the exposed end of said connecting shaft portion and with said paddle wheel to secure said paddle wheel and said drive mechanism in close-coupled relation, and (l) a torque support element extending between said main support boom and said drive mechanism to resist movement of said drive mechanism relative to said main support.

2. Apparatus according to claim 1, further characterized by (a) cup spring means interposed between said connecting shaft portion and said paddle wheel.

* * * * *